United States Patent [19]

Monroe

[11] Patent Number: 4,634,341

[45] Date of Patent: Jan. 6, 1987

[54] AXIAL FLOW FANS

[75] Inventor: Robert C. Monroe, Houston, Tex.

[73] Assignee: Hudson Products Corporation, Houston, Tex.

[21] Appl. No.: 683,868

[22] Filed: Dec. 20, 1984

[51] Int. Cl.[4] ..... F04D 29/36

[52] U.S. Cl. ..... 415/129; 416/89; 416/207; 416/208

[58] Field of Search ..... 416/87, 207, 208, 205, 416/88, 89, 210, 202, 239; 415/129, 133, DIG. 3

[56] References Cited

U.S. PATENT DOCUMENTS

| | | | |
|---|---|---|---|
| Re. 13,879 | 2/1915 | Irving | 416/89 |
| 578,509 | 3/1897 | Drayton | 416/87 |
| 1,150,241 | 8/1915 | Banzhof | 416/210 X |
| 2,765,859 | 10/1956 | Hartzell et al. | 416/207 |
| 2,908,335 | 10/1959 | Petty | 415/129 X |
| 3,561,883 | 2/1971 | Berry | 416/207 X |
| 4,049,363 | 9/1977 | Baumann et al. | 416/162 X |
| 4,053,259 | 10/1977 | Bianchi | 416/208 |
| 4,187,056 | 2/1980 | Schwinn et al. | 416/207 |
| 4,275,993 | 6/1981 | Sprengling | 416/207 |
| 4,285,637 | 8/1981 | Thompson | 416/208 X |
| 4,345,877 | 8/1982 | Monroe | 416/239 |

FOREIGN PATENT DOCUMENTS

| | | | |
|---|---|---|---|
| 304446 | 3/1918 | Fed. Rep. of Germany | 416/207 |
| 1055746 | 4/1959 | Fed. Rep. of Germany | 416/207 |
| 25875 | 6/1923 | France | 416/207 |
| 26878 | 3/1924 | France | 416/205 |
| 769768 | 9/1934 | France | 416/207 |
| 1175 | of 1861 | United Kingdom | 416/87 |
| 3276 | of 1862 | United Kingdom | 416/87 |

*Primary Examiner*—Everette A. Powell, Jr.
*Attorney, Agent, or Firm*—Vaden, Eickenroht Thompson & Boulware

[57] ABSTRACT

There is disclosed an axial flow fan having blades which may be rotated about their axes to permit their pitches to be adjusted and which may be moved in a radial direction to adjust the clearance between their tips and the fan ring in which they rotate.

14 Claims, 6 Drawing Figures

6
16
13
30
32
26
24
27
5
33
26
24
26
4
23
6
5
4

33
30
32
21
27
26
24
16
29
19
20
22
13

22
23
25
19
17
20A
25
29
28
26
31
32
33

AXIAL FLOW FANS

This invention relates generally to large diameter, axial flow fans which are particularly well suited for use in cooling towers or other industrial installations. More particularly, it relates to improvements in fans of this type having blades whose pitches may be adjusted in accordance with desired operating conditions.

In a prior fan of this type, which is shown and described in U.S. Pat. No. 4,345,877, assigned to the assignee of the present application, the inner ends of the blades have reduced necks which are received within sockets about the periphery of the hub. Each blade is held in fixed position on the hub by means of bolts which are mounted on the socket and extendible to move an abutment shoulder on the outer end of the neck into engagement with an oppositely facing shoulder about the socket. The bolts may be retracted to permit the neck of the blade to be received within or removed from the socket, or to permit the blade to be rotated to a desired position in order to, with adjust its pitch, following which the bolts may be reextended so as to reengage the abutment shoulder on the neck with the shoulder on the socket.

In another fan of this type, which is manufactured and sold by the assignee of this application, the neck of each blade is received and tightly gripped between inner curved surfaces on split clamps, which in turn have outer surfaces held between spaced apart plates about the periphery of the hub to prevent rotation of the clamps. More particularly, bolts extend through holes in the plates and clamps on opposite sides of the blade, and nuts on the bolts are manipultable to tighten the plates against the clamps and the clamps against the blade neck so as to hold the blade against rotation about its axis as it rotates with the hub. The nuts may be manipulated in order to relieve the tight engagement of the clamps about the blade necks and thereby permit the blades to be rotated about their axes in order to adjust their pitches, and then retightened to again hold the blade against rotation. When the blades are held tightly between the clamps, abutment shoulders on the outer ends of their necks engage the outer ends of the clamps to limit outward radial movement of the blades and absorb radial thrust.

The efficiency and thus the operating cost of axial flow fans depends to a large extent on maintaining minimum clearance between the tips of the blades and the fan rings in which they rotate. Maintaining close tolerances is particularly difficult in the case of large diameter fans, as above described, where the blades may be forty feet or more from tip to tip, and where the housing forming the fan ring may be made of precast, arcuate concrete sections, or of plastic, as is often the case in wet cooling towers or other installations where corrosion is a problem.

It has been proposed to minimize these clearances by lining the fan rings of large industrial fans of this type with a layer of honeycomb material which may be crushed by rollers which rotate with one or more of the blades. Although linings of this type are helpful when the fan ring is out of round, they do not maintain the desired tolerance in the case of fans having fan rings which are undersized or oversized a radial distance greater than the thickness of the uncrushed layer. Therefore, the primary object of this invention is to provide a fan of this type in which close tolerances may be maintained between the tips of the blades and the fan ring, despite undersizing or oversizing of the fan ring, and, more particularly, to provide such a fan in which the blades are mounted on the hubs by means of clamps in the manner above described.

This and other objects, are accomplished, in accordance with the illustrated embodiment of the present invention, by an axial flow fan of the construction above described, but having, in addition thereto, a means by which the means mounting each blade may be moved in a radial direction with respect to the hub. Thus, in the event the fan ring is oversized or undersized, each blade may be moved radially to the extent necessary to maintain the desired tolerances between their tips and the fan ring. In the preferred and illustrated embodiment of the invention, the mounting means for each blade comprises split clamps disposable about the inner ends of the blade, and means for connecting the clamps to the hubs and to one another in order to rotate the blade with the hub and tightly engage the clamps about the inner end of the blade, and means for selectively loosening the engagement of the clamps about the inner end of the blade to permit blade to be rotated about its axis in order to adjust its pitch. More particularly, and in accordance with the novel aspects of this invention, the clamps are connected to the hub for radial movement with respect thereto, whereby the blade may be moved with the clamps to adjust the clearance between its tip and the fan ring.

As illustrated, the hub is further similar to that above described in that it has spaced apart plates and radially aligned holes in the plates, each blade has a cylindrical neck and an abutment shoulder on the inner end of the neck, and the clamps have inner surfaces for fitting about the neck of the blade outwardly of the shoulder, outer surfaces which fit closely between the plates to hold them against rotation, and holes which are aligned with one another and the holes in the plates on opposite sides of the blade neck. More particularly, bolts extend through the aligned holes, and nuts on the bolts may be manipulated to draw the hub plates toward one another and the clamps to be tightly engaged about the blade neck so as to told the blade against rotation about its axis, or to loosen the engagement of the clamps about the blade neck to permit the blade to be rotated about its axis in order to adjust its pitch.

In accordance with the present invention, however, the fan also includes slider plates having holes therein aligned with the holes in the hub plates and clamps to receive the bolts, and the holes in the hub plates are radial slots, so that, when the nuts are loosened, the slider plates and clamps, and thus the blade, may be moved radially. More particularly, the slider plates are connected to the hub plates by means which is operable to move the slider plates, and thus the clamps and blade, radially toward or away from the axis of the hub. As illustrated, the connecting means comprises a bracket on each hub plate, a radially extending bolt connecting each bracket with a slider plate, and nuts on the bolt for drawing the slider plate toward or away from the brackets and then locking it against radial movement. As illustrated, the brackets and slider plates have oppositely facing flanges with holes through which the bolts extend, and lock nuts are mounted on the bolt on opposite sides of the slider plate flange.

In the drawings wherein like reference characters are used throughout to designate like parts:

Figure 1:
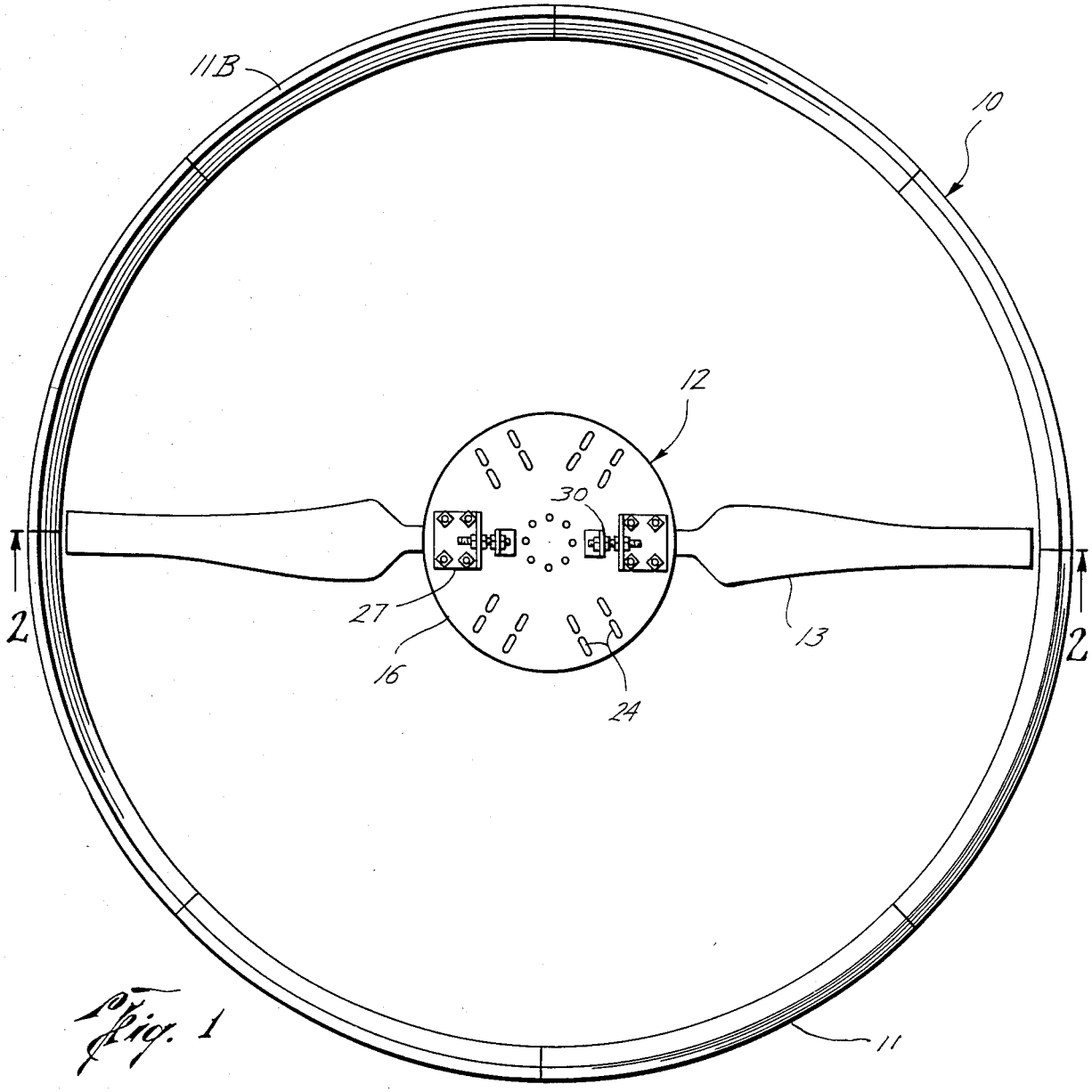
FIG. 1 is a plan view of an axial flow fan constructed in accordance with the present invention.
Figure 2:
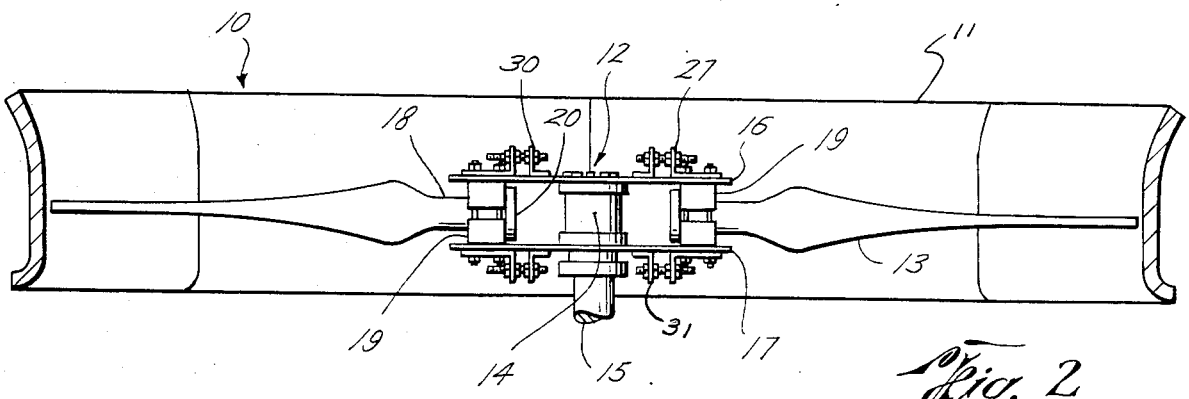
FIG. 2 is a cross sectional view of the fan of FIG. 1, as seen along broken lines 2—2 thereof.
Figure 3:
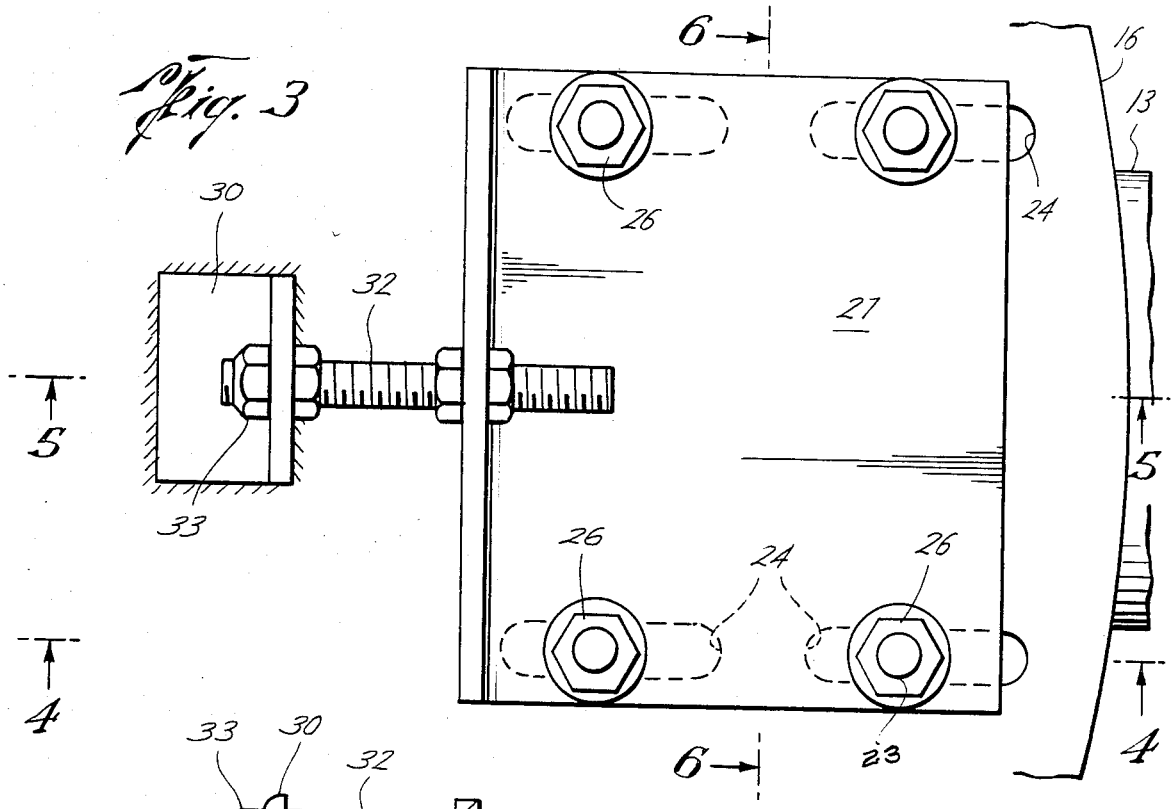
FIG. 3 is an enlarged top plan view of a portion of the fan of FIGS. 1 and 2 and showing the connection of the upper slider plate for one of the blades to the bracket on the top plate of the hub.
Figure 4:
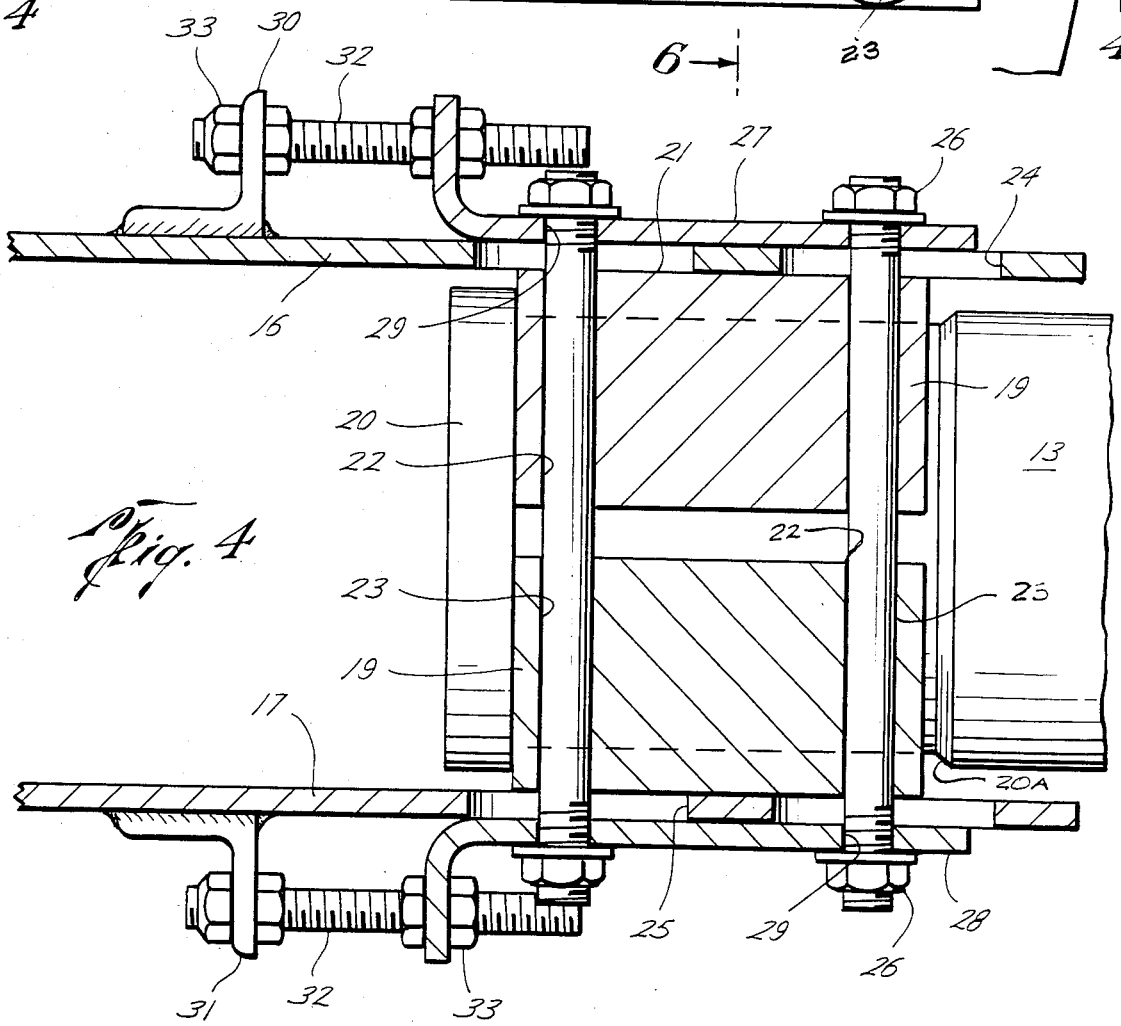
FIG. 4 is a longitudinal sectional view of the portion of the fan shown in FIG. 3, as seen along broken lines 4—4 thereof, and showing the clamps and bolts by which the blade is mounted on the hub.
Figure 5:
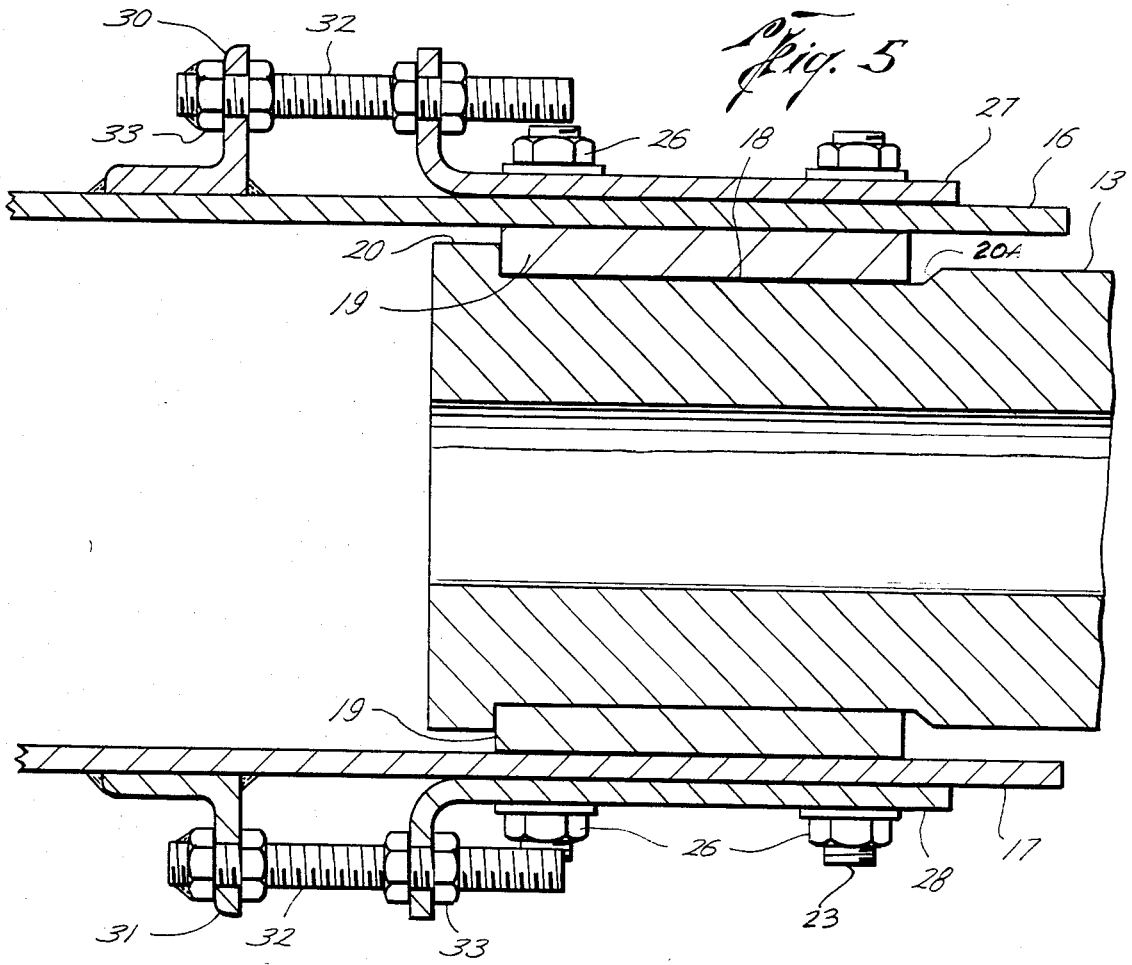
FIG. 5 is another longitudinal sectional view of the same portion of the fan, but as seen along broken lines 5—5 of FIG. 3.
Figure 6:
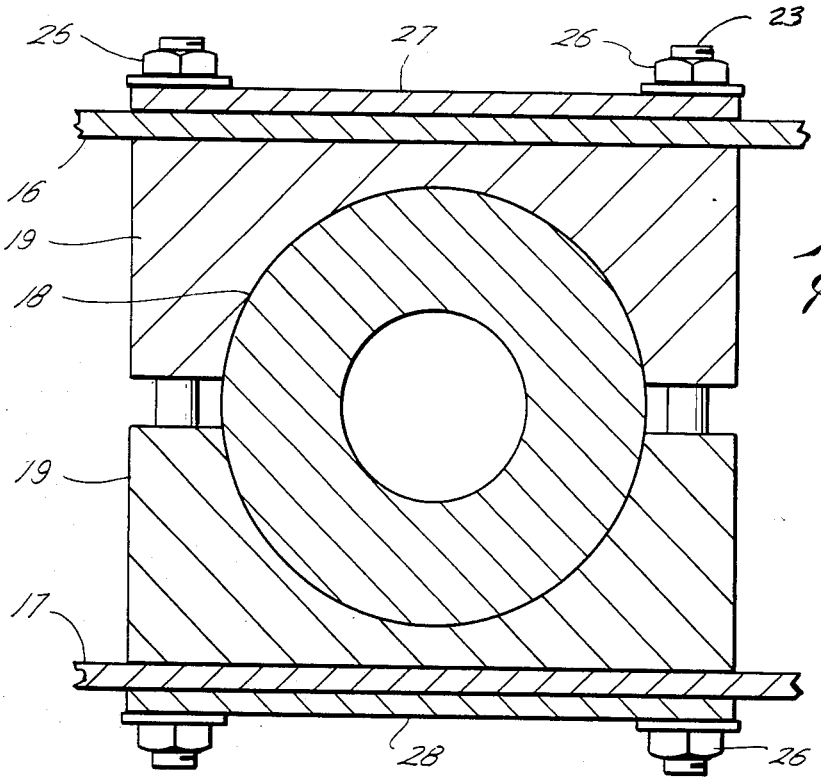
FIG. 6 is a cross sectional view of the portion of the fan shown in FIGS. 2 to 5, and as seen along broken lines 6—6 of FIG. 3.

The fan shown in FIGS. 1 and 2, and designated in its entirety reference character 10, comprises a fan ring 11 made up of arcuate, precast concrete sections 11B, a hub 12 rotatable about the axis of the ring, and blades 13 mounted on the hub for rotation therewith. As shown in FIG. 2, the hub includes a spool 14 mounted on the upper end of a rotatable drive shaft 15, and upper and lower disc shaped plates 16 and 17 mounted on the spool in vertically spaced apart relation. Each of the blades 13 has a reduced, cylindrical neck 18 which is adapted to be mounted on the hub intermediate the hub plates 16 and 17, as will described in detail to follow. Although the fan is shown to have two diametrically opposed blades 13, it may be provided with more blades, and means are provided on the upper and lower hub plates for this purpose. The fans blades are hollow, as indicated in FIGS. 5 and 6, and made of fiberglass reinforced plastic.

As shown, and as previously described, each blade is mounted for rotation with the hub by means of split clamps 19 which are mounted on and disposed between the hub plates, and which have inner, arcuate surfaces for fitting closely about the cylindrical neck 18 of the blade. Each blade has a flange 20 on its inner end to provide an abutment shoulder adapted to engage the inner ends of the clamps, and thus absorb the radial thrust of the blades during rotation, and a beveled shoulder 20A close to the outer ends of the clamps. The outer surfaces 21 of the clamps are flat for fitting tightly against the flat inner sides of the upper and lower hub plates 16 and 17, and have radially aligned holes 22 formed therein to receive bolts 23 on opposite sides of the neck of the blade for holding the arcuate surfaces of the clamps tightly about the neck of the blade, and thus holding the blade against rotation about its axis as the blade is rotated with the hub.

More particularly, the bolts 23 extend through radial slots 24 in the upper plate 16 and radial slots 25 in the lower hub plate 17. Thus, as will be described, nuts 26 and 27 threaded over the upper and lower ends of the bolts 23 may be manipulated to relieve the tight engagement between the hub plates and the clamps and the clamps and the neck of the blade, whereby the neck of the blade may be rotated within the clamps. As also described, this also permits the clamps, and thus the blade, to be moved in a radial direction with respect to the hub plates, so that it is not only possible to adjust the pitch of each blade, but also to adjust the clearance between the tips of the blades and the fan ring in the case of undersized or oversized fan rings. Then, when the blades are so adjusted, the nuts may be manipulated to draw the hub plates tightly against the clamps and the clamps about the neck of the blade to hold the blade against rotation about its axis.

As will be appreciated, in large diameter blades of the type contemplated by this invention, it may be difficult if not impossible to manually move the blade and its clamps axially with respect the hub. Thus, as will be described, the clamps are so connected to the hub as to permit them and thus the blade to be mechanically moved in a radial direction. For this purpose, upper and lower slider plates 27 and 28 are mounted on the outer sides of the upper and lower hub plates 16 and 17, and have radially aligned holes 29 therein which receive the bolts outwardly of the slots 24 in the hub plates, whereby washers beneath the nuts are clamped against the outer sides of the slider plates. More particularly the upper slider plate 27 is connected to a bracket plate 30 welded or otherwise secured to the upper side of hub plate 16, and the lower slider plate 28 is connected to a bracket 31 similarly mounted on the lower side of the lower plate 17. Thus, a nut 32 is received through aligned holes in the flanges on the brackets and plates, and nuts 33 are threaded over the bolts at opposite sides of the flanges. One set of nuts may be welded to the bolt, and the other set may be manipulated to move the slider plate radially toward or away from the bracket, and then locked in such position. Thus, one such not of each set provides the means for moving the slider plate along the bolt, while the other permits the plate to be locked against further radial movement.

As previously mentioned, the fan may include more than the two blades shown. For this purpose, and as shown in FIG. 1, the hub plates are provided with a plurality of sets of radially extending and aligned slots 24, with the sets being equally spaced apart about the circumference of the hub, and with the hub plates being spaced from one another intermediate the slot so as to receive mounting clamps for the additional blades.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. An axial flow fan, comprising a fan ring, a hub rotatable about the axis of the fan ring and having a pair of spaced apart plates on opposite sides of the hub, each plate having radially aligned holes, a pair of blades each having a cylindrical neck and an abutment shoulder on the inner end of the neck, and means for mounting each blade on the hub for rotation with the hub and for rotation about its axis, including clamps having inner surfaces for fitting about the neck of the blade outwardly of the shoulder, outer surfaces which fit closely between a pair of plates to hold them against rotation, and holes which are aligned with one another and the holes in the plates on opposite sides of the blade neck, bolts which extend through the aligned slots, and nuts on the bolts for selectively drawing the hub plates toward one another to hold the blade against rotation about its axis or loosening the engagement of the clamps about the neck of the blade to permit the blade to be rotated about its axis in order to adjust its pitch, slider plates having holes therein aligned with the holes in the hub plates and clamps to receive the bolts, the holes in the hub plates being radial slots, so that, when the nuts are loosened, the slider plates and clamps and thus the blade may be moved in a radial direction, means connecting the slider plates to the hub plates and operable to move the slider plates in such radial direction, said connecting means comprising a bracket on each hub plate, a radially extending bolt connecting each bracket with a slider plate, and nuts on the bolts for moving the slider plates toward and away from the brackets and then locking them against radial movement.

2. An axial flow fan of the character defined in claim 1, wherein the brackets and slider plates have oppositely facing flanges with holes through which the bolts extend.

3. An axial flow fan, comprising a fan ring, a hub rotatable about the axis of said fan ring, said hub having a pair of hub plates extending perpendicularly to the axis of said fan ring on opposite sides of the hub, a pair of blades each having a cylindrical neck on one of its ends, a pair of clamps disposed about said cylindrical neck of each blade, each of said clamps having an arcuate surface fitted closely about a portion of said cylindrical neck, connecting means for loosely connecting each pair of clamps to each other and to one of said hub plates such that said blade can be rotated about the axis of said cylindrical neck to adjust its pitch during periods of non-operation of the fan and tightly connecting said clamps to each other and to said hub plate such that said blade can be restrained from rotating about the axis of said cylindrical neck to maintain its adjusted pitch as it rotates with said hub during periods of operation of the fan, slider plates each connected to one of said connecting means and moveably mounted on one of said hub plates, and means for moving each said slider plate radially away from and toward the axis of said fan ring, and, thereby moving said connecting means, said clamps and said blade to adjust the clearance between said fan ring and the free ends of said blades, said means for moving each said slider plate radially away from and toward the axis of said fan ring comprising a stationary bracket mounted on said hub plate and a bolt which extends radially through a hole in a flange on said bracket and a hole in a flange on said slider plate, said bolt having a pair of nuts threaded on one of its ends, one of said nuts being positioned on one side of the adjacent flange and the other of said nuts being positioned on the other side of the adjacent flange, and a locking means on the other of its ends.

4. An axial flow fan as recited in claim 3, wherein said locking means comprises a pair of nuts threaded over the end of said bolt, one of said nuts being positioned on one side of the adjacent flange and the other of said nuts being positioned on the other side of the adjacent flange.

5. An axial flow fan as recited in claim 3, wherein said connecting means comprises a bolt which extends through a hole in said slider plate, a radial slot in said hub plate and a hole in each of said clamps, said bolt having a nut threaded on one of its ends and a surface engaging means on the other of its ends.

6. An axial flow fan as recited in claim 5, wherein said surface engaging means comprises a nut threaded on the end of said bolt which extends through said hole in said slider plate, said radial slot in said hub plate and said hole in each of said clamps.

7. An axial flow fan as recited in claim 4, wherein said connecting means comprises a bolt which extends through a hole in said slider plate, a radial slot in said hub plate and a hole in each of said clamps, said bolt having a nut threaded on one of its ends and a surface engaging means on the other of its ends.

8. An axial flow fan as recited in claim 7, wherein said surface engaging means comprises a nut threaded on the end of said bolt which extends through said hole in said slider plate, said radial slot in said hub plate and said hole in each of said clamps.

9. An axial flow fan, comprising a fan ring, a hub rotatable about the axis of said fan ring, said hub having a pair of spaced apart hub plates disposed perpendicular to the axis of said fan ring on opposite sides of the hub, a plurality of blades, each of said blades having a cylindrical neck on one of its ends, and, associated with each of said blades, a pair of clamps disposed about said cylindrical neck of each said blade, each of said clamps having an arcuate surface fitted closely about a portion of said cylindrical neck, connecting means for loosely connecting each pair of said clamps to each other and to a pair of said hub plates such that each said blade can be rotated about the axis of said cylindrical neck to adjust its pitch during periods of non-operation of the fan and tightly connecting said clamps to each other and to said hub plates such that said blade can be restrained from rotating about the axis of said cylindrical neck to maintain its adjacent pitch as it rotates with said hub during periods of operation of the fan, a pair of slider plates each connected to said connecting means, each of said slider plates being moveably mounted on one hub plate of each pair of said hub plates, and means for moving said slider plates radially away from and toward the axis of said fan ring. and, thereby, moving said connecting means, said clamps and said blade to adjust the clearance between said fan ring and the free ends of said blades, said means for moving said slider plates radially away from and toward the axis of said fan ring comprising a pair of stationary brackets, each of said brackets being mounted on one of said hub plates, and a bolt which extends radially through a hole in a flange on each of said brackets and a hole in a flange on each of said slider plates, said bolt having a pair of nuts threaded on one of its ends, one of said nuts being positioned on one side of the adjacent flange and the other of said nuts being positioned on the other side of the adjacent flange, and a locking means on the other of its end.

10. An axial flow fan as recited in claim 9, wherein said locking means comprises a pair of nuts threaded over the end of said bolt, one of said nuts being positioned on one side of the adjacent flange and the other of said nuts being positioned on the other side of the adjacent flange.

11. An axial flow fan as recited in claim 9, wherein said connecting means comprises a bolt which extends through a hole in each of said slider plates, a radial slot in each of said hub plates and a hole in each of said clamps, said bolt having a nut threaded on one of its ends and a surface engaging means on the other of its ends.

12. An axial flow fan as recited in claim 10, wherein said surface engaging means comprises a nut threaded on the end of said bolt which extends through said hole in each of said slider plates, said radial slot in each of said hub plates and said hole in each of said clamps.

13. An axial flow fan as recited in claim 10, wherein said connecting means comprises a bolt which extends through a hole in each of said slider plates, a radial slot in each of said hub plates and a hole in each of said clamps, said bolt having a nut threaded on one of its ends and a surface engaging means on the other of its ends.

14. An axial flow fan as recited in claim 13, wherein said surface engaging means comprises a nut threaded on the end of said bolt which extends through said hole in each of said slider plates, said radial slot in each of said hub plates and said hole in each of said clamps.

* * * * *